United States Patent [19]

Collier

[11] 3,962,745

[45] June 15, 1976

[54] WALL RUG CLEANING MACHINE

[76] Inventor: Sydney Wellington Collier, R.R. No. 2, Norval, Ontario, Canada

[22] Filed: Nov. 21, 1974

[21] Appl. No.: 525,773

[52] U.S. Cl. ..... 15/322; 285/7
[51] Int. Cl.[2] ..... A47L 7/00
[58] Field of Search ..... 15/321, 322; 285/7

[56] References Cited

UNITED STATES PATENTS

| | | | |
|---|---|---|---|
| 2,270,579 | 1/1942 | Chamberlin et al. | 15/322 X |
| 2,909,800 | 10/1959 | Grindle et al. | 15/322 X |
| 3,616,482 | 11/1971 | Brycki | 15/321 |
| 3,705,437 | 12/1972 | Rukavina, Jr. et al. | 15/322 X |
| 3,747,155 | 7/1973 | Koellisch | 15/322 |

FOREIGN PATENTS OR APPLICATIONS

| | | | |
|---|---|---|---|
| 892,658 | 3/1962 | United Kingdom | 15/322 |

*Primary Examiner*—Billy J. Wilhite
*Assistant Examiner*—C. K. Moore

[57] ABSTRACT

A cleaning device for cleaning wall rugs and the like is disclosed. It comprises a cleaning head, a rigid tube and means for connecting the cleaning head to the rigid tube to permit relative movement between the head and the rigid tube. The head has a fluid discharge open end enclosure for applying cleaning fluid to a rug surface throughout a first area and an annular opening substantially surrounding the open end of the discharge enclosure through which a vacuum is applied to the rug surface throughout a second area. The spent cleaning solution passes through the annular opening to a vacuum source regardless of direction of movement of the cleaning head while it is in contact with the rug surface to be cleaned.

3 Claims, 4 Drawing Figures

10
18
20
22
23
21
19
24
11
12
17
20

10
4
11
3
12
3
4

11
12
17
17
20

12
17
11
13
14
16
15
18
20

WALL RUG CLEANING MACHINE

FIELD OF THE INVENTION

This invention relates to a novel head for a rug cleaning machine for use in cleaning carpets which are hung on walls and the like.

BACKGROUND OF THE INVENTION

With the increased use of carpets and floor coverings, various methods of cleaning such rugs have been developed. One such method is the application of liquid cleaning solution to a rug and the use of a scrubbing action to remove the dirt and soil therefrom. Another method is to apply steam or hot cleaning solution to a rug, then vacuum the spent solution up by means of a suction source. Another method involves using a hot cleaning solution which is applied to a rug, brushed by a reel type brush and the spent solution removed by vacuum. A particular structural arrangement in a rug cleaning machine which uses this method is described in my co-pending patent application Ser. No. 180,701. The rug cleaning machines presently on the market for cleaning floor rugs are usually bulky, heavy and cumbersome. Such restrictions are not of any significance when cleaning floor rugs since the machines are moved slowly and deliberately across the surcace to be cleaned.

Recently there has been an increase in the use of carpets as wall covering, and such increased use has created a cleaning problem. The methods of cleaning rugs as presently known cannot be adapted satisfactorily when cleaning wall rugs.

The above-mentioned problem is overcome by the vacuum cleaning head arrangement according to this invention which may have an intake opening completely surrounding a discharge opening which is connected for relative movement about the end of a rigid tube whereby the rigid tube acts as the handle. The rigid tube is in turn connected to a vacuum source. The structure defining the liquid discharge opening may have two or more fluid discharge nozzles located therein which point outwardly through the discharge opening. Each of the nozzles can be connected to a small flexible hose which is common to all of the nozzles and is in communication with a pressurized cleaning fluid source. A valve mechanism may be provided on the flexible hose so that the operator can readily control the application of cleaning fluid to the rug surface. By holding the rigid tube the operator can press the head against the surface to be cleaned and apply cleaning fluid to the rug, the spent cleaning fluid being drawn through the intake opening and passed to the vacuum source by way of the rigid tube. For easier manipulation of the head, the head may be mounted at an end of the rigid tube for rotational movement about an axis of the tube. The flexible hose has sufficient extra length and flexibility to allow the head to rotate about the axis of the tube a limited distance.

SUMMARY OF THE INVENTION

Accordingly it is an object of this invention to provide a light easy-to-handle cleaning device for applying cleaning solution to a wall rug and for vacuuming the spent cleaning solution immediately after application.

Since any liquid applied to a wall will flow down the wall due to gravity and leave unsightly stains, it is another object of this invention to provide a novel head with a continuous intake opening surrounding a discharge opening through which cleaning fluid is discharged to prevent any spent cleaning fluid from escaping and dripping down the wall. It is a further object of the invention to provide a head mounted on the end of a rigid hose for relative movement about an axis of the hose for easier handling.

BRIEF DESCRIPTION OF THE DRAWINGS

These and other objects, advantages and features of the invention will become apparent in the following detailed description of a preferred embodiment shown in the accompanying drawings wherein.

DETAILED DESCRIPTION OF A PREFERRED EMBODIMENT

Figures 1, 2, 3, 4:
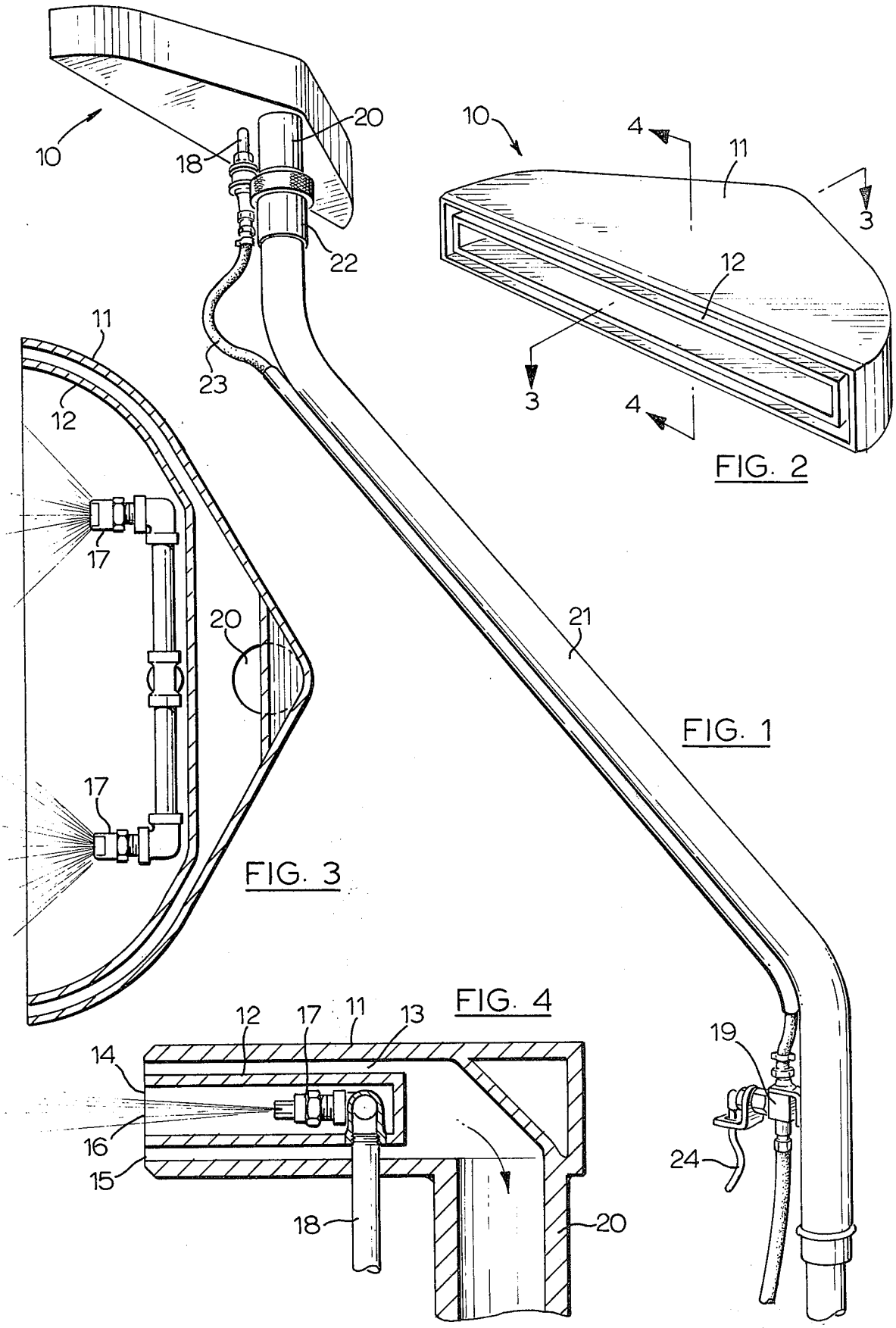
FIG. 1 is a perspective view showing the head and related parts of the apparatus according to this invention.
FIG. 2 is a perspective front view of the head.
FIG. 3 is a cross-sectional view of the head taken along the line 3—3 of FIG. 2.
FIG. 4 is a cross-sectional view of the head taken along line 4—4 of FIG. 2.

Referring now to the drawings, a head for a rug cleaning machine generally designated at 10, has an open-ended housing or outer wall portion 11 which substantially surrounds an inner wall portion 12 to define an annular chamber or passageway 13 between wall portions 11 and 12. Head 10 has at its cleaning surface 14 an annular intake opening 15 defined between outer wall portion 11 and inner wall portion 12 and a discharge opening 16 defined by inner wall portion 12. The inner wall portion 12 defines an open-ended enclosure wherein discharge nozzles 17 are mounted and are connected to a flexible hose 18 which is common to both nozzles and is in turn connected to a pressurized cleaning fluid source (not shown). A valve mechanism 19 which may be spring-loaded controls the flow of cleaning fluid through hose 18. The head 10 has a tubular neck portion 20 which is integral with the outer wall portion 11 and is in communication with the annular chamber 13. Neck 20 is connected to a rigid tube 21 for relative movement about the longitudinal axis at the end of the rigid tube by swivel connector 22 which allows the head and the tube to rotate relative to each other. Rigid tube 21 at the end opposite to head 10 is connected to a vacuum source. Flexible hose 18 has excess length 23 near the swivel connector 22 to allow the head to rotate without causing any restrictions in movement of the head. The rigid tube 21 may serve as the handle for the cleaning device, however, it is understood that both hose 18 and tube 21 may be flexible where a rigid pole or the like is attached to head 10 to serve as the handle therefor.

The inner wall 12 defines an enclosure having a chamber with an open end 16 defined by the free end **12*a* of inner wall 12. The enclosure chamber assists in directing the fluid discharge from nozzles 17 onto the rug surface where the free end 12*a* of the inner wall defines the discharge opening 16. The outer wall 11 defines a housing surrounding inner wall 12 to define the annular chamber 13 having an open end in the form of an annular intake opening 15 defined by and between the free end 11*a* of outer wall 11 and the free end 12*a* of inner wall 12. Annular intake opening 15 covers an area or region which surrounds the area covered by discharge opening 16. The free end 11*a* of outer wall 11 may lie substantially in the same plane as the free end 12***a* of inner wall 12 as shown in FIG. 3 of the drawings where the free end 12*a* precludes the vacuum created in annular chamber 13 drawing the cleaning solution away from the rug surface prior to its having contacted the rug surface. It is understood, however, that the free end of inner wall 12*a* may either extend slightly beyond or slightly short of the free end of outer wall 11 since the depth of the rug nap prevents the cleaning solution from either being drawn into chamber 13 prior to contact with the rug surface if the free end of the inner wall 12 extends short of the free end of the outer wall 11 or from streaking the rug surface if the free end of the inner wall 12 extends beyond the free end of the outer wall 11.

In operating the cleaning machine, the operator holds the rigid tube 21 with both hands and with one finger on the trigger 24 of valve 19. The swivel connector 22 allows the head and tube 21 to rotate relative to each other to facilitate the handling and manoeuvering of the device by the operator. With the cleaning surface 14 pressed against the rug and with the vacuum source operating, the operator pulls trigger 24 to discharge cleaning fluid through nozzles 17 out the discharge opening 16 onto the rug. The force of the spray of the cleaning fluid in conjunction with emulsifying agents in the hot cleaning solution is sufficient to bring the dirt and soil to the surface of the rug. As the head is slowly moved across the surface to be cleaned, the vacuum intake opening 15 which surrounds discharge opening 16, draws up the spent cleaning fluid into the annular passageway 13 and through neck 20 into rigid tube 21 and eventually into a receiver holding the spent cleaning solution. The vacuum intake opening surrounds the discharge opening so that the position of the head on the wall is immaterial where substantially all of the cleaning fluid is removed from the rug so that staining of the rug is prevented.

It will be understood that while the preferred embodiment of the invention has been shown and described, variations may be made in the details thereof without departure from the spirit of the invention or scope of the appended claims.

I claim:

1. A cleaning device for wall rugs and the like comprising a head, a rigid tube, and means for connecting said head to said rigid tube which is adapted to permit relative movement of said head about an axis of said rigid tube; said head including means for applying cleaning fluid to a rug surface throughout a first area, means for applying a vacuum to a rug surface throughout a second area which substantially completely surrounds said first area, an inner wall which has a free end defining an enclosure for said means for applying cleaning fluid where said first area is defined by and within said free end of the inner wall, and an outer wall which has a free end and which surrounds said inner wall to define an annular chamber between said inner wall and said outer wall, said annular chamber having an open end where said second area is defined between the free ends of said inner and outer walls, said annular chamber being in communication with a source of vacuum, the free ends of said inner and outer walls lying substantially in the same plane where said head is free of any projections extending substantially beyond said plane in a direction away from said head so that the free ends of said inner and outer walls are adapted to contact a rug surface to be cleaned.

2. A cleaning device of claim 1 wherein said means for applying cleaning fluid comprises at least one fluid discharge nozzle positioned within said enclosure and directed to discharge cleaning fluid towards the free end of said inner wall, said at least one discharge nozzle being in communication with a source of pressurized cleaning fluid.

3. A cleaning device as claimed in claim 2 wherein means is provided to control the flow of cleaning fluid to said at least one fluid discharge nozzle.

* * * * *